US006745852B2

(12) United States Patent
Kadaster et al.

(10) Patent No.: US 6,745,852 B2
(45) Date of Patent: Jun. 8, 2004

(54) PLATFORM FOR DRILLING OIL AND GAS WELLS IN ARCTIC, INACCESSIBLE, OR ENVIRONMENTALLY SENSITIVE LOCATIONS

(75) Inventors: Ali G Kadaster, The Woodlands, TX (US); Keith K. Millheim, The Woodlands, TX (US)

(73) Assignee: Anadarko Petroleum Corporation, The Woodlands, TX (US)

( * ) Notice: Subject to any disclaimer, the term of this patent is extended or adjusted under 35 U.S.C. 154(b) by 0 days.

(21) Appl. No.: 10/142,741

(22) Filed: May 8, 2002

(65) Prior Publication Data

US 2003/0209363 A1 Nov. 13, 2003

(51) Int. Cl.[7] ..... E21B 29/12; E21B 15/02; E02D 7/24

(52) U.S. Cl. ..... 175/5; 175/7; 175/57; 405/204; 405/200; 405/226

(58) Field of Search ..... 175/5–8, 57; 405/203–206, 405/208, 224, 226, 227, 228

(56) References Cited

U.S. PATENT DOCUMENTS

| | | | | | |
|---|---|---|---|---|---|
| 3,564,862 | A | | 2/1971 | Hashemi | 62/56 |
| 3,602,323 | A | | 8/1971 | Schuh | 175/57 |
| 3,626,836 | A | | 12/1971 | Schneidler | 98/33 |
| 3,650,119 | A | | 3/1972 | Sparling | 62/55 |
| 3,664,437 | A | | 5/1972 | McCulloch | 175/5 |
| 3,670,813 | A | | 6/1972 | Duncan | 166/0.5 |
| 3,675,430 | A | | 7/1972 | Haimila | 61/46 |
| 3,749,162 | A | | 7/1973 | Anders | 166/0.5 |
| 3,783,627 | A | | 1/1974 | Blurton | 61/46.5 |
| 3,791,443 | A | | 2/1974 | Burt | 165/45 |
| RE28,101 | E | | 8/1974 | Knorr | 175/5 |
| 3,874,180 | A | * | 4/1975 | Sumner | 405/198 |
| 3,878,662 | A | * | 4/1975 | Cernosek | 52/745.18 |
| 3,908,784 | A | * | 9/1975 | Blurton et al. | 180/119 |
| 3,946,571 | A | | 3/1976 | Pate | 61/69 R |
| 3,968,999 | A | | 7/1976 | Keller | 302/66 |
| 3,986,781 | A | | 10/1976 | Condo | 404/31 |
| 3,986,783 | A | | 10/1976 | Rowley | 404/95 |
| 3,999,396 | A | * | 12/1976 | Evans | 405/196 |
| 4,056,943 | A | * | 11/1977 | Tarrant | 405/196 |
| 4,065,934 | A | * | 1/1978 | Dysarz | 405/196 |
| 4,161,376 | A | * | 7/1979 | Armstong | 405/196 |
| 4,440,520 | A | | 4/1984 | Fisher | 404/72 |
| 4,456,072 | A | | 6/1984 | Bishop | 166/362 |
| 4,470,725 | A | | 9/1984 | Kure | 405/212 |
| 4,484,841 | A | | 11/1984 | Einstabland | 405/212 |
| 4,511,288 | A | * | 4/1985 | Wetmore | 405/217 |
| 4,522,258 | A | | 6/1985 | DeWald | 166/57 |
| 4,544,304 | A | | 10/1985 | Fisher | 404/17 |

(List continued on next page.)

FOREIGN PATENT DOCUMENTS

| | | |
|---|---|---|
| WO | WO 00/09857 | 2/2000 |
| WO | WO 01/49966 A1 | 7/2001 |

OTHER PUBLICATIONS

Credson, James; Hackett, Matthew; Kendall, Paul; Merrill, Elizabeth; Smith, Rebecca and Stirling Alison; "Gravel–less Drill Pad Design" for Phillips Alaska, Inc., Anchorage Alaska, Apr. 2001.

*Primary Examiner*—Thomas B. Will
*Assistant Examiner*—Thomas A. Beach
(74) *Attorney, Agent, or Firm*—Raymond R. Ferrera; Arnold & Ferrera, LLP

(57) ABSTRACT

A system for drilling wells includes a plurality of platform modules, which are interconnected to one another on site to form a unitary platform structure. The interconnected platform modules are elevated above a surface on plurality of legs coupled to at least some of the platform modules. The elevated interconnected platform modules support drilling and auxiliary equipment. The system is well adapted for use in arctic, inaccessible, shallow water or environmentally sensitive locations.

21 Claims, 8 Drawing Sheets

U.S. PATENT DOCUMENTS 4,571,117 A 2/1986 Johnson ..... 404/77
4,666,340 A * 5/1987 Cox ..... 405/204
4,784,526 A * 11/1988 Turner ..... 405/204
4,821,816 A * 4/1989 Willis ..... 175/57
4,848,475 A 7/1989 Dean ..... 166/357
4,899,832 A * 2/1990 Bierscheid, Jr. ..... 173/187
5,072,656 A 12/1991 Mochizuki ..... 454/255
5,109,934 A 5/1992 Mochizuki ..... 175/170
5,122,023 A 6/1992 Mochizuki ..... 414/22.61
5,125,857 A 6/1992 Mochizuki ..... 439/894
5,248,005 A 9/1993 Mochizuki ..... 175/85
5,957,807 A * 9/1999 Takamatsu et al. ..... 477/98
6,045,297 A 4/2000 Voorhees et al.
6,048,135 A 4/2000 Williford et al.
6,161,358 A * 12/2000 Mochizuki et al. ..... 52/651.05
6,298,928 B1 10/2001 Penchansky
6,443,659 B1 * 9/2002 Patout ..... 405/196
6,499,914 B1 * 12/2002 Patout et al. ..... 405/196
6,533,045 B1 3/2003 Cooper
2002/0046531 A1 4/2002 Bockhorn et al.
2002/0074125 A1 6/2002 Fikes et al.
2002/0112888 A1 8/2002 Leuchtenberg

* cited by examiner

PLATFORM FOR DRILLING OIL AND GAS WELLS IN ARCTIC, INACCESSIBLE, OR ENVIRONMENTALLY SENSITIVE LOCATIONS

FIELD OF THE INVENTION

The present invention relates generally to the field of oil and gas drilling and more particularly to a method of and system for building structures and drilling oil and gas wells in arctic, inaccessible or environmentally sensitive locations without disturbing the ground surface as in conventional land drilling operations.

DESCRIPTION OF THE PRIOR ART

The drilling and development of land oil and gas wells require a designated area on which to locate the drilling rig and all the support equipment. Usually drilling locations are reached by some type of road or other access. In rare situations, access is via airlift, either by helicopter, fixed wing aircraft, or both.

Many areas of the world that have potential for oil and gas exploration and development are constrained by special circumstances that make transportation of drilling equipment to a drilling site difficult or impossible. For example, oil and gas may be found in terrain with near-surface water accumulations, such as swamps, tidal flats, jungles, stranded lakes, tundra, muskegs, and permafrost regions. In the case of swamps, muskegs and tidal flats, the ground is generally too soft to support trucks and other heavy equipment. In the case of tundra and permafrost regions, heavy equipment can be supported only during the winter months.

Additionally, certain regions where oil and gas may be found are environmentally sensitive, such that surface access by transporting vehicles can damage the terrain or affect wildlife breeding areas or migration paths. The environmental problems are particularly acute in arctic tundra and permafrost regions. In such areas, road construction is either prohibited or limited to temporary seasonal access.

There are substantial oil and gas reserves in the far northern reaches of Canada and Alaska. However, drilling in such regions presents substantial engineering and environmental challenges. The current art of drilling onshore in arctic tundra is enabled by the use of special purpose vehicles, such as Rolligons™, that can travel across ice roads built on frozen tundra.

Ice roads are built by spraying water on a frozen surface at very cold temperatures. Ice roads are typically 35 feet wide and 6 inches thick. At strategic locations, the ice roads are made wider to allow for staging and turn around capabilities.

Land drilling in arctic regions is currently performed on ice pads, which are typically 500 feet by 500 feet, which for the most part comprises 6-inch thick ice. Typically, the rig itself is built on a 6 to 12-inch thick ice pad. A reserve pit is typically constructed with over a two-foot thickness of ice plus an ice berm, which provides at least two feet of freeboard above the pit's contents. These reserve pits, which are also referred to as ice-bermed drilling waste storage cells, typically have a volume capacity of 45,000 cubic feet for an estimated 15,000 cubic feet of cuttings and fluid effluent. In addition to the ice roads and the pad, an arctic drilling location typically includes an airstrip, which is essentially an ice road.

The ice roads may be tens of miles to hundreds of miles in length, depending upon the proximity or remoteness of the existing infrastructure. The fresh water needed for the ice to construct the roads and pads is usually obtained from lakes and ponds that are typically numerous in such regions. The construction of an ice road may typically require 1,000,000 gallons of water per mile. Over the course of a winter season, as much as 200,000 gallons per mile may be required to maintain the ice road. Therefore, for a ten mile ice road, a total of 12,000,000 gallons of water would have to be picked up from nearby lakes and sprayed on the selected road bed route. An airstrip may require up to 2,000,000 gallons and a single drill pad may require up to 1,700,000 gallons of water. For drilling operations on a typical 30-day well, the requirement would be approximately 20,000 gallons per day, for a total of 600,000 gallons for the well. A 75-man camp would require and additional 5,000 gallons per day or 150,000 gallons per month. Sometimes, there are two to four wells drilled from each pad, frequently with a geological side track in each well.

In summary, for a winter program of 7 wells, requiring about 75 miles of road, with 7 drilling pads, an airstrip, a 75-man camp and drilling of 5 new wells, plus re-entry of two wells left incomplete, the fresh water requirements could be on the order of 150 million gallons.

Currently, arctic land drilling operations may be conducted only during the winter months. Typically, roadwork commences by the first half of January simultaneously with location building and rig mobilization. Due to the lack of ice roads, initial mobilizations are done with special purpose vehicles such as Rolligons™, approved for use on the tundra. Drilling operations typically commence the first week of February and last until the middle of April, at which time all equipment and waste pit contents must be removed before the ice pads and roads melt. However, in the Alaskan North Slope, the tundra is closed to all traffic from May 15 to July 1 due to nesting birds. If the breakup is late, then prospects can be fully tested before demobilizing the rig. Otherwise all of the infrastructure has to be rebuilt the following season.

From the foregoing, it may be seen that there are several drawbacks associated with current arctic drilling technology. Huge volumes of water are pumped out of ponds and lakes and then allowed to thaw out and become surface run off again. The ice of the roads can become contaminated with lube oil and grease, antifreeze, and rubber products. In addition to environmental impact, the economic costs of drilling in arctic regions is very high. Operations may be conducted only during the coldest parts of the year, which is typically less than 4 or 5 months. Actual drilling and testing may be conducted in a window of only two to four months or less. Therefore, development can occur during less than half the year. During each drilling season, the roads and pads must be built and all equipment must be transported to and removed from the site, all at substantial financial and environmental cost.

SUMMARY OF THE INVENTION

The present invention provides a method of and system for drilling wells on land or in relatively shallow water where the rig and drilling facility are elevated above the surface of the ground. The present invention also provides a platform for accommodating other equipment and structures besides drilling equipment. The system of the present invention includes a plurality of platform modules, which are interconnected to one another on site to form a unitary platform structure. The interconnected platform modules are elevated above a surface on plurality of legs coupled to at least some of the platform modules. The elevated interconnected platform modules can support drilling and auxiliary equipment, as well as other structures such as storage structures, living quarters and the like.

The drilling platform modules may be a of a size and shape capable of being transported to a drilling location by aircraft, land vehicles, sleds, boats or barges, or the like. The modules may be configured to float, so that they may be towed over water to the drilling location. Some of the platform modules may comprises structural, weight-bearing members for supporting derricks and heavy equipment, such as drawworks, motors, engines, pumps, cranes, and the like. Others of the platform modules may comprise special purpose modules, such as pipe storage modules; material storage modules for cement, drilling fluid, fuel, water, and the like; and equipment modules including equipment, such as generators, fluid handling equipment, and the like.

The legs are adapted to be driven or otherwise inserted into the ground to support the elevated drilling platform. The legs may comprise sections that may be connected together to form legs of any suitable length. The legs may include passageways for the flow of fluids such as air, refrigerants, cement, and the like. The legs may include a bladder that may be inflated with air or other fluids to provide increased support for the legs.

According to a method of the present invention, a plurality of first drilling platform modules are transported to a first drilling location. The first platform modules may be transportable by aircraft or special purpose vehicles that are adapted to cause minimal harm to the environment. The first platform modules are interconnected to form a first drilling platform. The first drilling platform is then elevated over the first drilling location. Drilling equipment may be installed on the first drilling platform before or after elevation. After installing the drilling equipment, one or more wells may be drilled.

In arctic regions, the modules are transported, and the first platform is built and elevated, during the winter season, while the ground can support vehicles and the equipment. After the platform has been elevated, drilling can continue throughout the year.

In another aspect of the method of the invention, one or more second platform modules may be transported to a second drilling location. The second platform modules are interconnected and elevated to form either a complete second drilling platform or the nucleus for a second drilling platform. When it is desired to drill from the second drilling platform, drilling equipment is transported to and installed on the second drilling platform. The drilling equipment may be transferred from the first drilling platform. Alternatively, the drilling equipment may comprise a second set of drilling equipment transported from a base or other location. The equipment may be used to drill wells from the second platform as part of a multi-season, multi-location drilling program or as a relief well for wells drilled from the first platform.

DESCRIPTION OF THE PREFERRED EMBODIMENT

Figure 1:
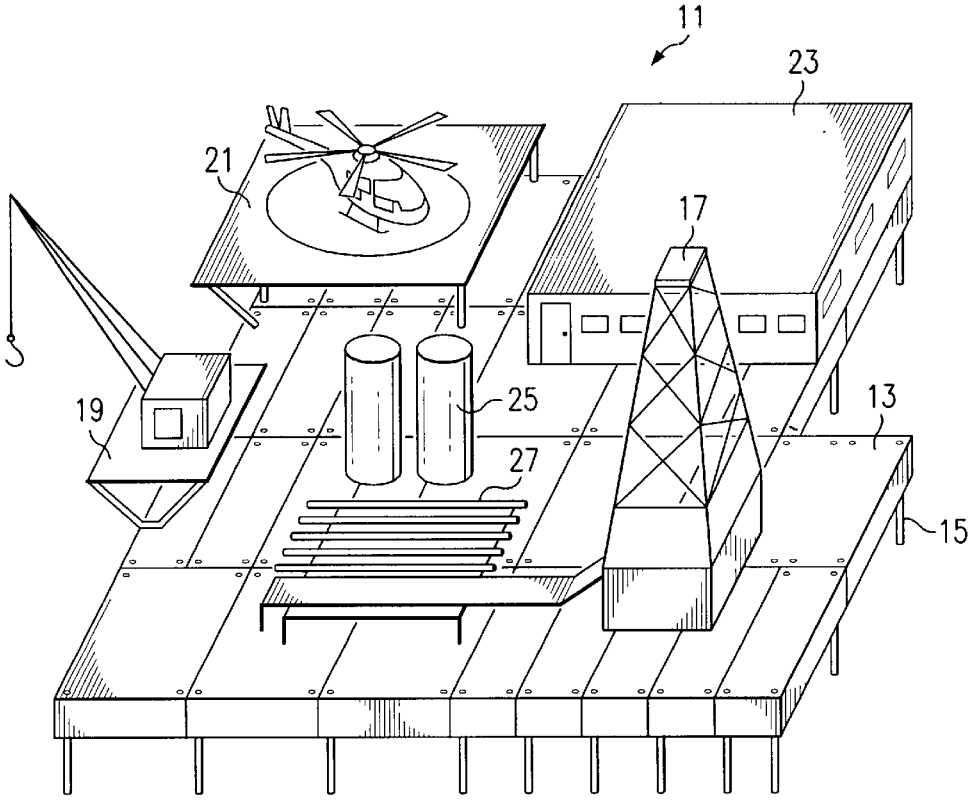
FIG. 1 is a perspective view of a drilling platform according to the present invention.
Figure 2:
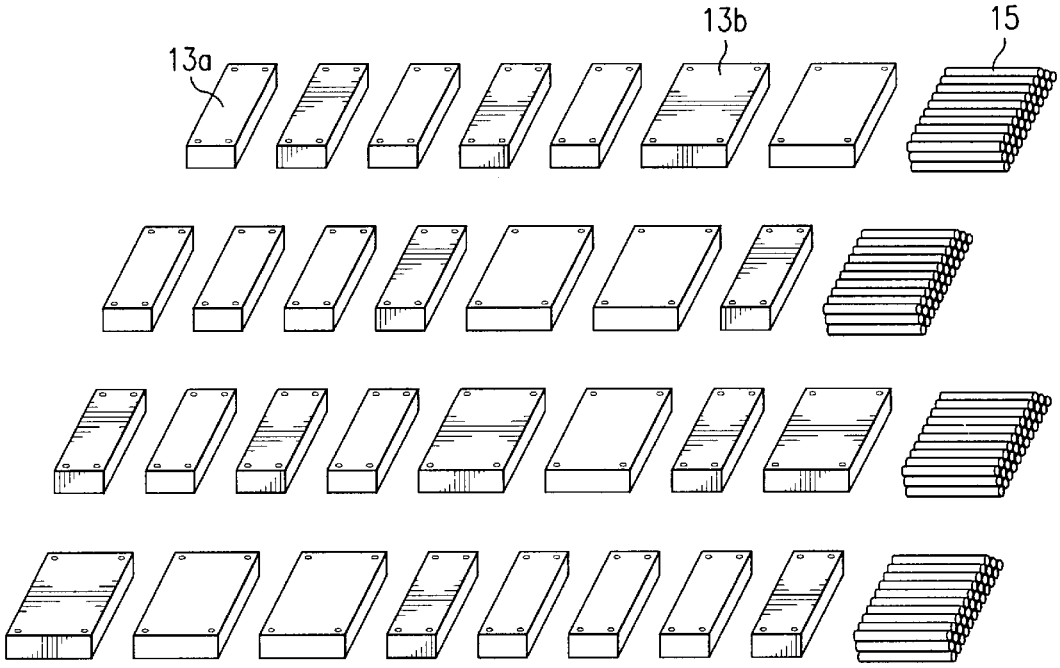
FIG. 2 is a perspective view of a plurality of platform modules and legs awaiting assembly according to the present invention.

Referring now to the drawings, and first FIG. 1, a drilling platform according to the present invention is designated generally by the numeral 11. As will be explained in detail hereinafter, platform 11 comprises a plurality of interconnected platform modules 13 that are elevated above the ground on legs 15. Platform 11 is adapted to support various equipment and facilities used in oil and gas drilling or production operations. For example, platform 11 supports a derrick 17, a crane 19, a helicopter pad 21, a drilling fluid handling enclosure 23, bulk storage tanks 25, and oilfield tubular goods 27. The equipment and facilities illustrated in FIG. 1 are for purposes of example only. Those skilled in the art will recognize that other facilities and equipment may be included on Platform 11.

Platform 11 is constructed by transporting to a drilling site a plurality of platform modules 13 and legs 15. Platform modules 13 are of a size and weight that enable them to be transported to the drilling site by aircraft or by special purpose overland transporters, such as Rolligon™ vehicles. In the illustrated embodiment, platform modules 13 are rectangle box-like structures of steel or other material, such as emerging composites or the like, about 40 feet in length and from 10 to 20 feet in width. The shapes and sizes of the modules described herein are for the purpose of example and illustration. Those skilled in the art will recognize that the modules may be of other shapes, sizes and configurations. As will be explained in detail hereinafter, platform modules 13 may be purely structural, load bearing in nature, or they may house equipment or other facilities in addition to their load bearing capabilities. Legs 15 are typically tubular with joints at their ends so that they may be connected together to form legs of appropriate lengths. However, the legs may be of other cross-sections or configurations.

Figure 3:
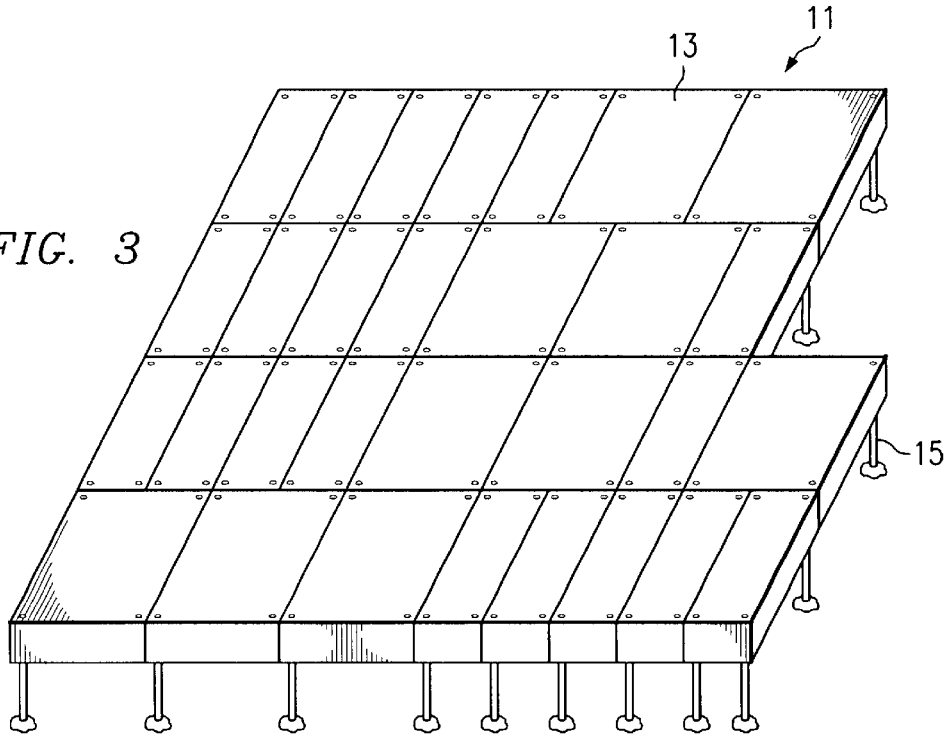
FIG. 3 is a perspective view of the platform modules and legs of FIG. 2 assembled according to the present invention.

Referring now to FIG. 3, the modules 13 of Platform 11 are shown connected together and at least partially raised on legs 15. A complete platform may be assembled from Modules 13 on the ground and then lifted as a unit on legs 15. Alternatively, one or more modules 13 may be elevated to form a nucleus about which other modules may be elevated and connected together.

Figure 4A:
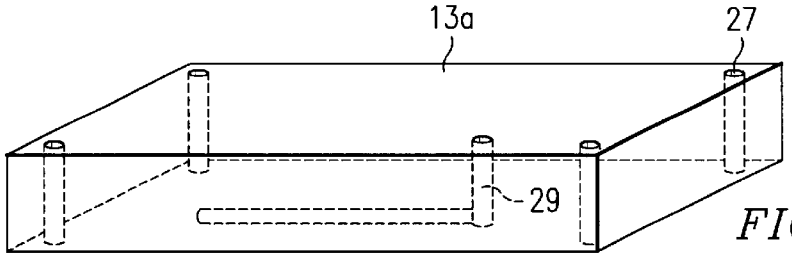
FIGS. 4A–4C are perspective views of examples of special purpose platform modules according to the present invention.
Figure 4B:
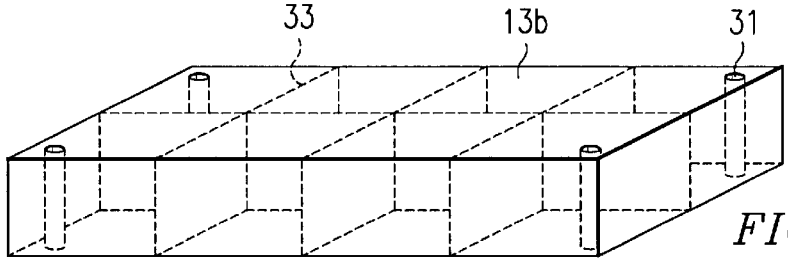
Figure 4C:
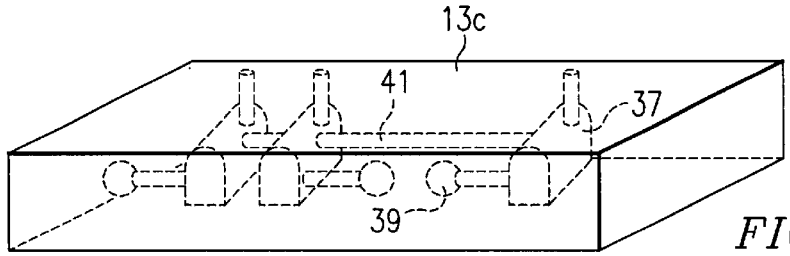

Referring now to FIGS. 4A–4C, there are shown various platform modules according to the present invention. Referring first to FIG. 4A, there is illustrated a fluid storage module 13*a*. Fluid storage module 13*a* includes at its corners holes 27 for the insertion of legs. Fluid storage module 13*a* is essentially a box-like hollow tank that includes a port or pipe 29 for the flow of fluids into and out of the interior of fluid storage module 13*a*. Fluid storage modules 13*a* may be used, for example, in place of a conventional reserve pit. At the completion of operations, fluid storage modules may be hauled away their contents, thereby eliminating the handling of waste fluids and risk of spillage.

Referring now to FIG. 4B, there is shown a structural load bearing module 13*b*. Again, load bearing module 13*b* is a box-like rectangle structure having leg holes 31 at its corners. As shown in phantom in FIG. 4B, load bearing module 13*b* includes internal structural reinforcement plating 33 to provide structural strength to module 13*b*. The internal structural reinforcement plating is illustrated for purposes of example; other reinforcement structures, such as trusses, I-beams, honey-combs and the like, may be utilized as are well known to those skilled in the art. Additionally, other shapes, structures and materials, such as composites, may be used to make the load bearing modules. Load bearing modules 13*b* may be positioned to support heavy equipment on the platform.

Referring to FIG. 4C, there is shown an example of an equipment module 13*c*. Again, equipment module 13*c* is a box-like rectangular structure. In the interior of equipment module 13*c* there is various equipment adapted for use in drilling or auxiliary operations. In the example of FIG. 4C, the equipment includes centrifuges 37 for solids control. The centrifuges 37 are powered by motors 39 connected by various manifolds 41 for the flow of fluid there through. Other fluid handling equipment, such as hydrocyclones and the like, may be included in equipment module 13*c*. From the foregoing, it will be apparent that the various modules may be assembled to provide both a structural platform as well as basic equipment and services for drilling operations.

Figure 5A:
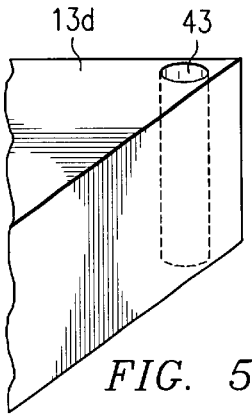
FIGS. 5A and 5B are perspective views of alternative leg attachment arrangements according to the present invention.
Figure 5B:
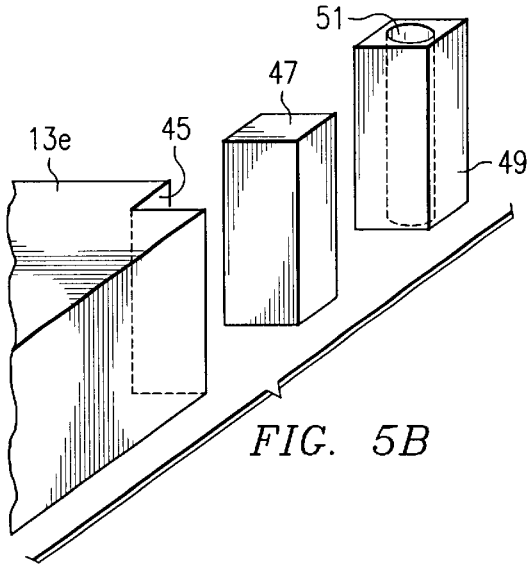

Referring now to FIGS. 5A and 5B, there are shown alternative arrangements for the connection of a leg to a platform module. In FIG. 5A, a module 13*d* includes adjacent one of its corners a tubular leg hole 43. A leg (not shown) is simply adapted to slide through leg hole 43. The leg is fixed in place with respect to leg-hole 43 by any suitable means, such as slips, pins, flanges, or the like. In FIG. 5B, there is shown an alternative arrangement in which a module 13*e* includes at one of its corners a right angle cutout 45. Cutout 45 is adapted to receive either a blank insert 47 or a leg engaging insert 49. Blank insert 47 may be fastened into notch 45 in the event that no leg needs to be positioned at a corner of module 13. Leg engaging insert 49 includes a bore 51, having an appropriate shape, that is adapted to slidingly engage a leg (not shown). Either insert 47 or insert 49, as appropriate, may be fastened into notch 45 with bolts or other suitable fastening means.

Figure 6A:
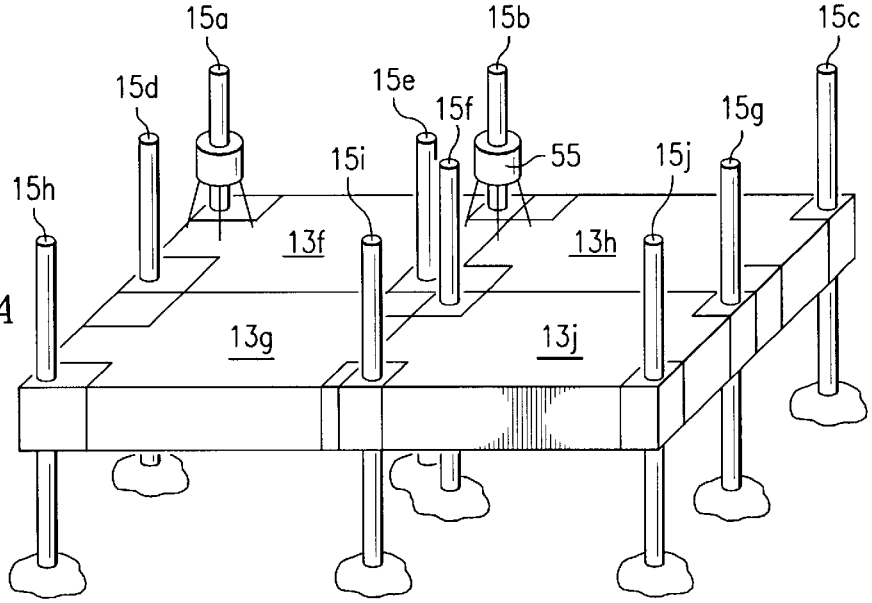
FIGS. 6A and 6B illustrate elevation of assembled platform modules according to the present invention.
Figure 6B:
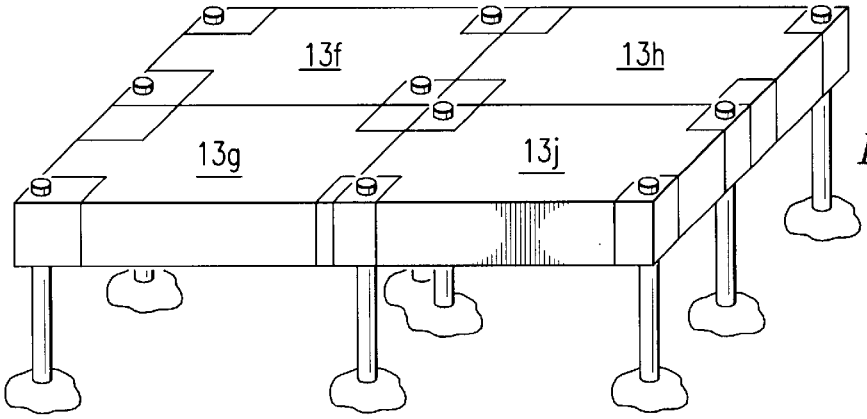

Referring now to FIGS. 6A and 6B, there is illustrated the positioning and lifting of a group of modules 13 with respect to a plurality of legs 15. A sufficient number of legs 15 is selected in order to provide sufficient support for the modules 13 and the equipment to be supported thereby. Modules 13 in FIG. 6 are of the type illustrated in FIG. 5B. Accordingly, blank inserts 47 or leg inserts 49 are appropriately affixed at corners of the modules 13. Then, the legs of appropriate lengths are inserted through the leg inserts and then drilled, driven or otherwise inserted to an appropriate depth in the ground. Then, the interconnected modules 13 are raised on the legs 15 to a position as shown in FIG. 6B. In FIG. 6A, lifting mechanisms are indicated generally by the numeral 55. The lifting mechanisms may be, for example, hydraulic or mechanical. The modules may also be lifted with cranes, helicopters, or other suitable lifting devices, all as would be apparent to one skilled in the art. It will be recognized that although legs 15 are illustrated as being tubular, other cross-sections and structures may be employed for the legs.

Figure 7A:
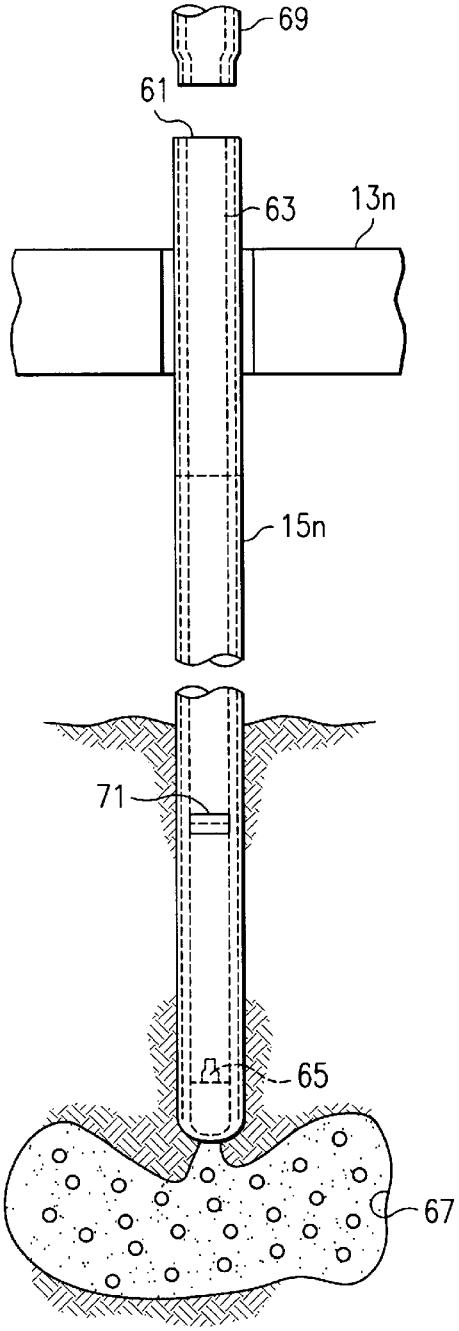
FIGS. 7A and 7B illustrate features of platform legs according to the present invention.
Figure 7B:
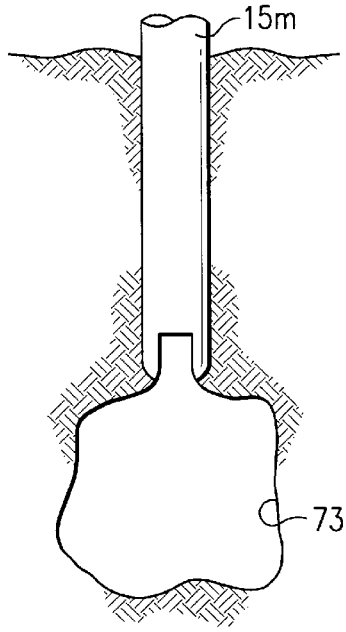

Referring now to FIGS. 7A and 7B, details of legs according to the present invention are illustrated. Referring first to FIG. 7A, a portion of a module 13*n* is shown elevated with respect to a leg 15. In the illustrated embodiment, leg 15*n* is a tubular member preferably having a main flow area 61 and an annular flow area 63. Leg 15*n* is thus configured to accommodate a circulating flow of fluids, such as refrigerants and the like. Leg 15*n* may include a retrievable section 65 disposed at its lower end to allow the pumping of cement or the circulation of other fluids down the main flow area 61. In the embodiment illustrated in FIG. 7A, cement 67 is pumped into the ground below retrievable 65. Cement 67 provides a footing for leg 15*n*. As indicated by pipe section 69, additional lengths of pipe can be inserted to lengthen leg 15*n* in order to provide sufficient support for module 13. Leg 15*n* may include a separable connection 71 which allows the lower end of leg 15*n* to be left in the ground when the platform is removed from the site.

In FIG. 7B, there is illustrated an alternative arrangement in which a leg 15*m* includes at its lower end an inflatable bladder 73. Inflatable bladder 73 may be inflated with air, cement, or another fluid to compact the earth around the lower end of leg 15*m* or to provide an additional footing for leg 15*m*.

Figure 8:
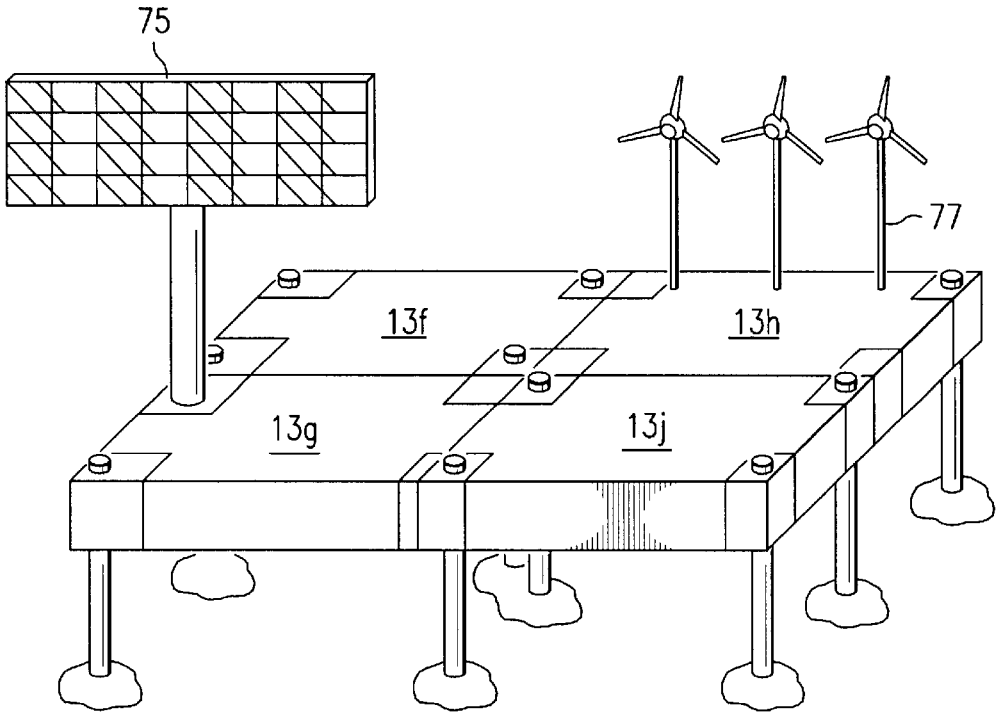
FIG. 8 illustrates renewable energy production facilities installed on a platform according to the present invention.

Referring now to FIG. 8, renewable energy sources may be supported by the platform according to the present invention. For example, a solar panel array 75 or wind mill power generators 77 may be supported by the platform. The renewable power sources, such as solar panel arrays 75 and wind mill 77, may provide energy for pumps, compressors, and other equipment. The renewable power sources may also provide energy for hydrate production. Renewable energy sources minimize fuel requirements for the drilling platform while at the same time minimizing air pollution and conserving production fluids.

Figure 9A:
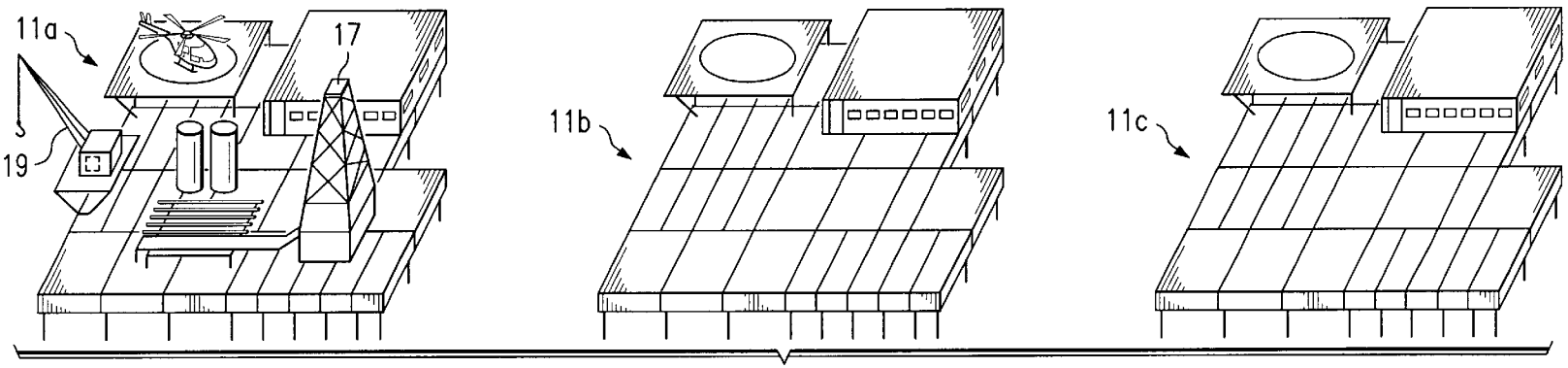
FIGS. 9A–9D illustrate a multiple well drilling program according to the present invention.
Figure 9B:
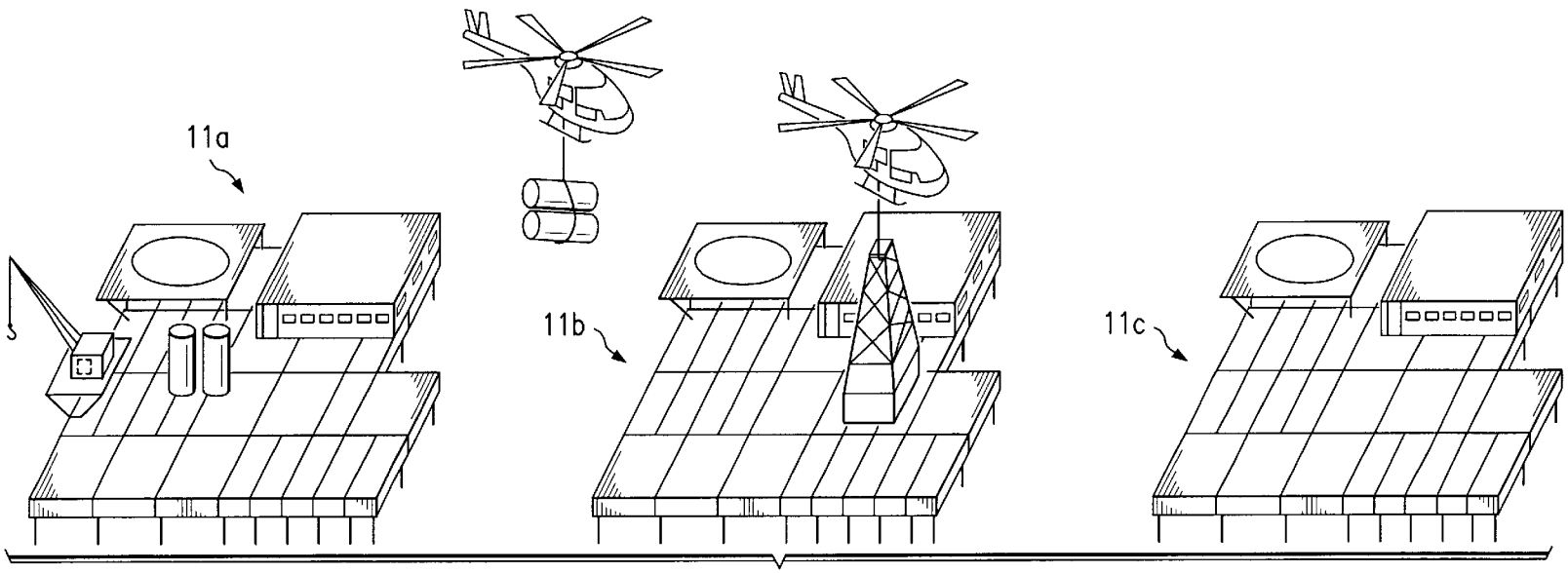

Referring now to FIGS. 9A–9B, there is illustrated a multi-year, multi-seasonal drilling program according to the present invention. In FIG. 9A, three platforms 11*a*–11*c* are transported to and erected at geographically spaced-apart locations. In the case of an arctic drilling program, platforms 11*a*–11*c* are transported and installed during the winter using either aircraft, such as helicopters, or surface vehicles on ice roads, or a combination thereof. By way of example, platform 11*b* may be positioned 100 miles from platform 11*a* and platform 11*c* may be positioned 300 miles from platform 11*b*. However, the distances are for purposes of example and other spacings and numbers of platforms may be provided. As shown in FIG. 9A, platform 11*a* has installed thereon a complete set of drilling equipment including a derrick 17, a crane 19, and the other equipment described with respect to FIG. 1. In FIGS. 9A–9B, platforms 11*b* and 11*c* do not have a complete set of drilling equipment installed thereon. Rather, they have only the structural platform features and other sets of fixed equipment, such as pumps, manifolds, generators and the like. Platforms 11*b* and 11*c* are awaiting the installation of the remaining drilling equipment. According to the present invention, one or more wells can be drilled from platform 11, while platforms 11*b* and 11*c* are standing idle.

Referring now to FIG. 9B, after the completion of the well or wells drilled from platform 11*a*, the necessary drilling equipment is transported from platform 11*a* to platform 11*b*. In the illustrated embodiment, the drilling equipment is transferred using aircraft such as helicopters. Since the transport is by air, the transfer may occur during a warm season. Also, since platform 11*b* is elevated above the ground surface on legs that are supported below the fall thaw zone, operations on platform 11*b* can be conducted during the warm season. The transport by air is for purposes of illustration. In appropriate terrains and seasons, the transport may be by Rolligon™ vehicle, barge, surface effect vehicle, or the like.

Figure 9C:
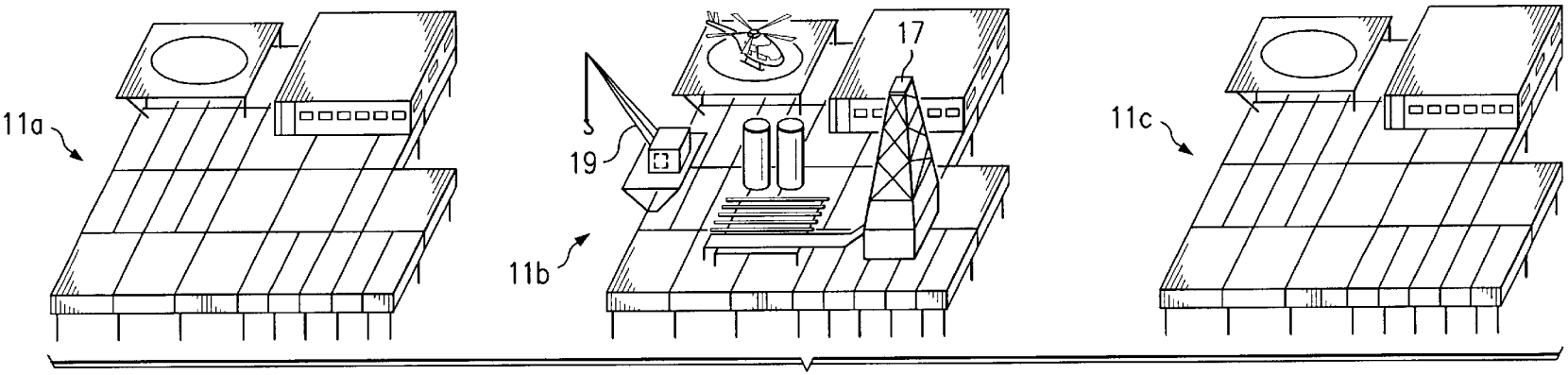
Figure 9D:
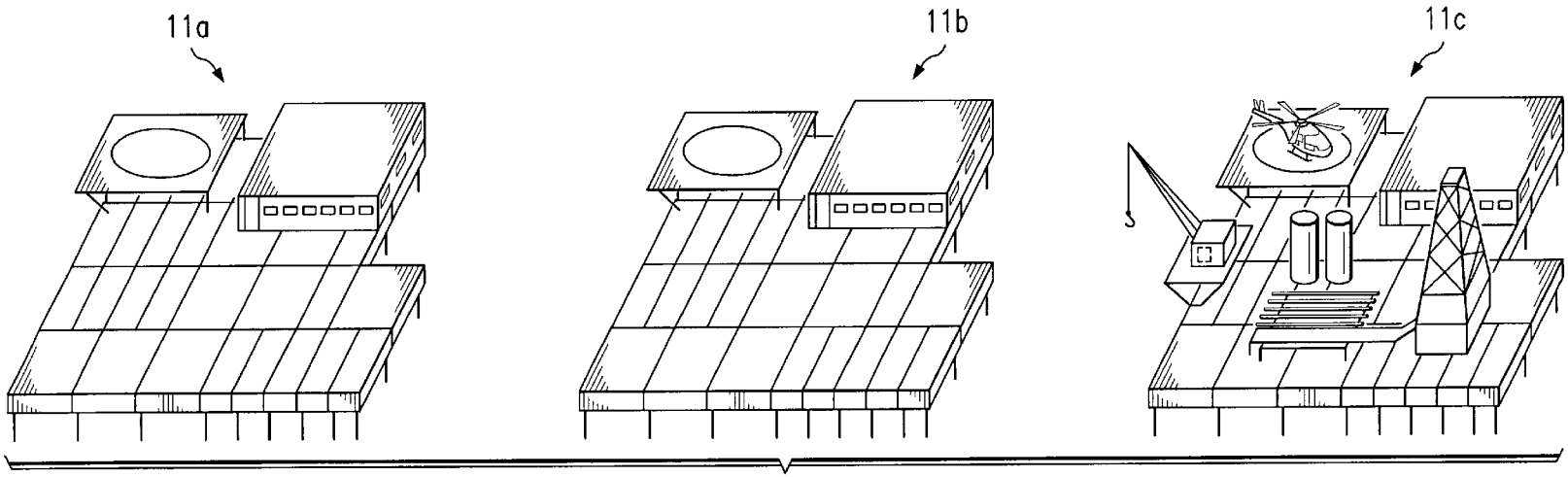

After the drilling equipment has been transported to and installed upon platform 11*b*, the remaining structural assembly of platform 11*a* may be left idle. When the drilling equipment is completely installed on platform 11*b*, drilling of one or more wells can commence, as shown in FIG. 9C. At the completion of drilling from platform 11*b*, the drilling equipment is then transferred from platform 11*b* to platform 11*c*, as illustrated in FIG. 9D. Again, the drilling equipment is preferably transported from platform 11*b* to platform 11*c* by aircraft. The transport of the drilling equipment may occur during any season of the year. Thus, according to the invention illustrated in FIGS. 9A–9B, the installation and operation of drilling equipment may be performed during any season of the year and not only during the coldest parts of the year. Thus, the time spent drilling may be doubled or even tripled according to the method of the present invention without substantial additional environmental impact. Also, the method and system of the present invention enable wells to be drilled and completed in the normal course of operations without the possibility of having to transport equipment to and from a drilling site multiple times.

Figure 10A:
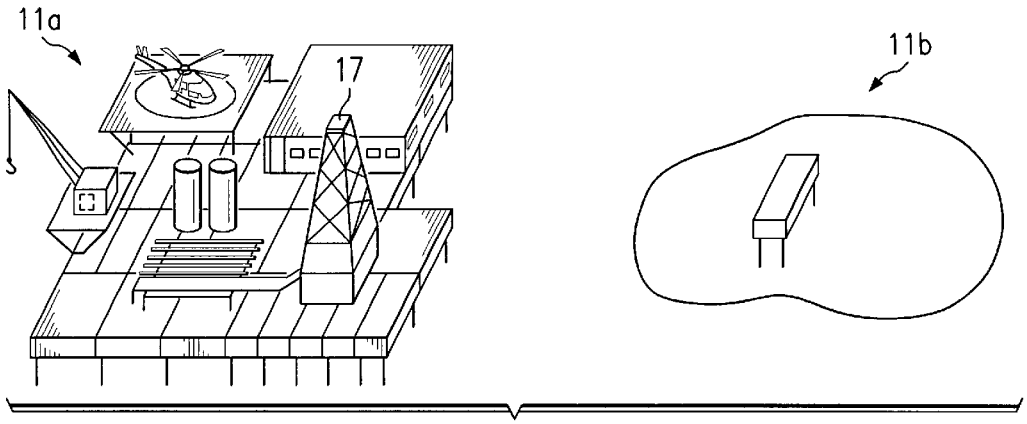
FIGS. 10A–10C illustrate further aspects of the well drilling program according to the present invention.
Figure 10B:
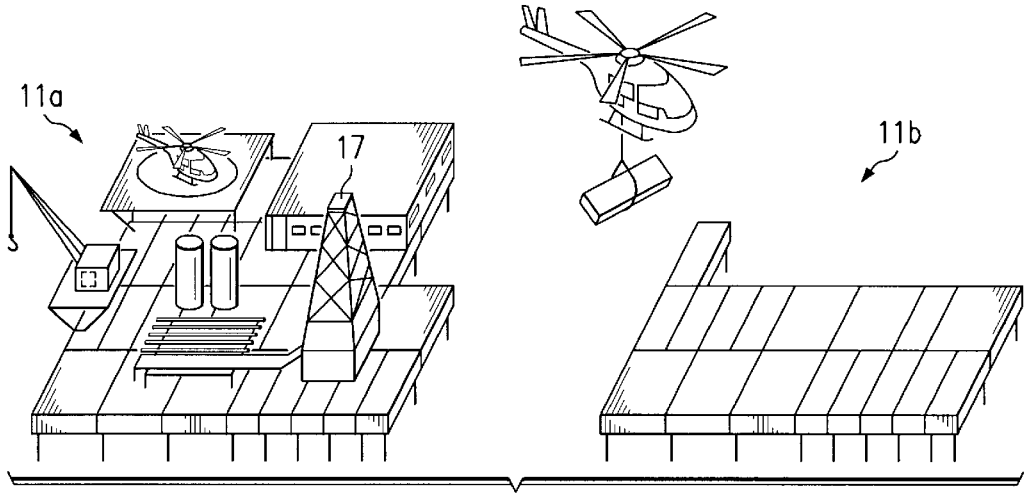
Figure 10C:
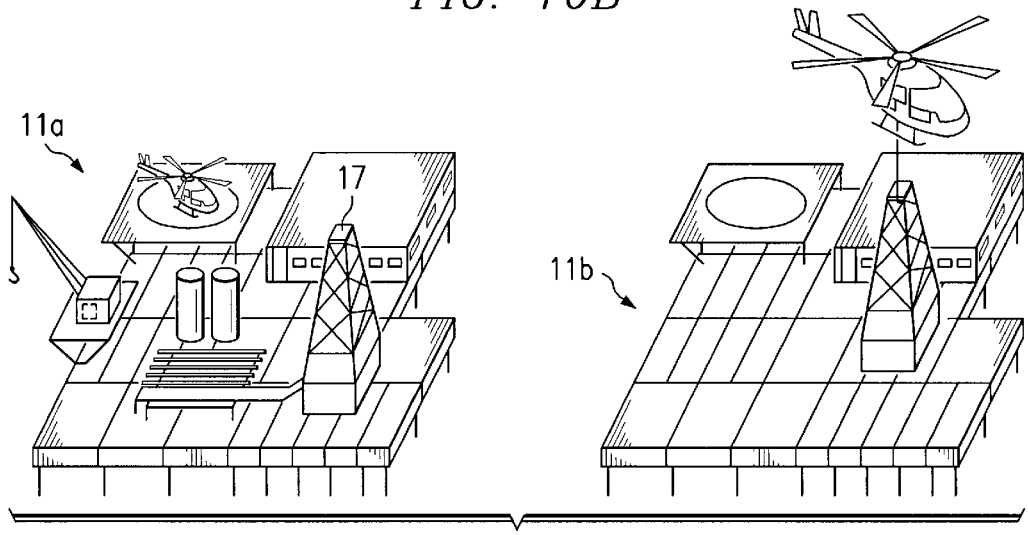

Referring now to FIGS. 10A–10C, there is illustrated an alternative implementation of a method according to the present invention. In FIG. 10A, a primary platform 11*a* is transported to and erected at a first location and a secondary platform 11*b* is transported to and erected at a second location geographically spaced apart from the first location. In FIG. 10A, platform 11*a* is a complete drilling platform while platform 11*b* comprises only a single module erected on legs. Platform 11*b* provides a nucleus about which a second complete platform may be erected should the need arise. The system as illustrated in FIGS. 10A–10C is well adapted, for example, to the drilling of a relief well for one drilled from platform 11*a*.

Referring to FIG. 10B, if it is necessary or desired to drill a well from the location of platform 11*b*, platform modules are transported to the location of platform 11*b* by helicopter or the like. Workers can use previously installed modules as a base for installing new modules. A crane can be positioned on the installed modules and skidded about to drill or drive legs and position new modules. As shown in FIG. 10C, after the second platform 11*b* is completed, then drilling equipment is transported thereto by helicopter or by other suitable transport means.

From the foregoing, it may be seen that the method and system of the present invention are well adapted to overcome the shortcomings of the prior art. A drilling platform may be transported to, assembled and elevated above, a location with minimal damage to a sensitive environment. Moreover, the present methods and systems of the present invention enable drilling operations to be conducted year-round in arctic areas, thereby making drilling in such areas substantially more cost effective.

What is claimed is:

1. A platform for drilling oil and gas wells, said platform comprising:

a plurality of interconnected platform modules;

at least one leg, coupled to at least one of said platform modules to support said interconnected modules above a surface; wherein said at least one leg further comprises a passageway for the passage of fluid therethrough and a bladder coupled to an end of said passageway; and drilling equipment supported by said interconnected platform modules.

2. The platform of claim 1, wherein each of said platform modules is transportable by aircraft.

3. The platform of claim 1, wherein at least one of said platform modules comprises:

a body; and a leg attachment member coupled to said body.

4. The platform of claim 3, wherein said attachment member is integral with said body.

5. The platform of claim 3, wherein said attachment member is separable from said body.

6. The platform of claim 1, wherein at least one of said platform modules comprises:

a body having at least one cut out therein.

7. The platform of claim 6, wherein said at least one cut out further comprises a blank member mountable in said cut out.

8. The platform of claim 6, wherein said at least one cut out further comprises a leg attachment member mountable in said cut out.

9. The platform of claim 8, wherein said leg attachment member further comprises a leg bore.

10. The platform of claim 1, wherein at least one of said platform modules comprises a structural members.

11. The platform of claim 1, wherein at least one of said platform modules comprises a fluid storage modules.

12. The platform of claim 1, wherein at least one of said platform modules comprises an equipment modules.

13. The platform of claim 1, wherein said fluid comprises cement.

14. The platform of claim 1, wherein said at least one legs comprises a severable portion, whereby a first portion of said leg can be separated from a second portion of said leg.

15. The platform of claim 1, wherein said drilling equipment further comprises a derrick.

16. The platform of claim 1, wherein said drilling equipment further comprises tubular goods.

17. The platform of claim 1, further comprising a crane supported by said interconnected platform modules.

18. The platform of claim 1, further comprising a helicopter pad supported by said interconnected platform modules.

19. The platform of claim 1, further comprising an energy generator supported by said interconnected platform modules.

20. The platform of claim 19, wherein said energy generator comprises a solar panel array.

21. The platform of claim 19, wherein said energy generator comprises a windmill power generator.

* * * * *